US006591455B2

(12) United States Patent
Heavenor

(10) Patent No.: US 6,591,455 B2
(45) **Date of Patent: *Jul. 15, 2003**

(54) HANDLE FOR HAND HELD UTENSILS AND IMPLEMENTS

(76) Inventor: Glen Heavenor, 118 Queens Drive, Glasgow G42 8BJ (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/894,756

(22) PCT Filed: May 22, 1997

(86) PCT No.: PCT/GB97/01402

§ 371 (c)(1),
(2), (4) Date: Aug. 27, 1997

(87) PCT Pub. No.: WO97/44164

PCT Pub. Date: Nov. 27, 1997

(65) Prior Publication Data

US 2001/0042279 A1 Nov. 22, 2001

(30) Foreign Application Priority Data

May 22, 1996 (GB) ..... 9610703
Sep. 14, 1996 (GB) ..... 9619246

(51) Int. Cl.[7] ..... A46B 5/02
(52) U.S. Cl. ..... 16/430; 15/167.1; 15/143.1
(58) Field of Search ..... 30/526, 322, 323, 30/327, 326, 324; 15/167.1, 143.1; 81/177.1; 16/430

(56) References Cited

U.S. PATENT DOCUMENTS 412,479 A * 10/1889 Davis ..... 15/143.1
D31,141 S * 7/1899 Lannon ..... D08/21
D34,213 S * 3/1901 Baxter ..... D08/21
2,056,447 A * 10/1936 Fell
2,094,240 A * 9/1937 Herrick et al. ..... 15/167.1
2,124,615 A * 7/1938 Foltz ..... 16/430
2,263,885 A * 11/1941 McGauley ..... 15/167.1 X
2,370,815 A * 3/1945 Ross ..... 30/62
2,934,776 A * 5/1960 Clemens ..... 15/167.1
4,038,719 A 8/1977 Bennett
4,128,937 A 12/1978 Adorney
4,149,811 A 4/1979 Coffman
4,259,761 A 4/1981 Earle
4,306,327 A * 12/1981 Zeski ..... 15/167 R
4,351,080 A * 9/1982 Grossmen
4,454,623 A * 6/1984 O'Halloran ..... 15/167 R
4,563,816 A * 1/1986 Jagger ..... 30/343
4,592,109 A * 6/1986 Borea et al.
4,599,920 A * 7/1986 Schmid ..... 16/11
4,672,706 A * 6/1987 Hill
D300,990 S * 5/1989 Jagger
4,885,818 A * 12/1989 Arterbury ..... 16/430
D324,838 S * 3/1992 Briscadieu ..... 74/594.4
5,365,881 A 11/1994 Sporn
5,522,109 A * 6/1996 Chan ..... 15/106
5,692,265 A * 12/1997 Dalury
6,178,583 B1 * 1/2001 Volpenhein ..... 15/167.1

* cited by examiner

*Primary Examiner*—Kenneth E. Peterson
(74) *Attorney, Agent, or Firm*—Clifford W. Browning; Woodard, Emhardt, Moriarty, McNett & Henry LLP

(57) ABSTRACT

A hand held utensil having a head portion connected to a handle, wherein the handle includes structure for encouraging a user of the utensil to present the head portion to an article at a preferred angle.

5 Claims, 3 Drawing Sheets

HANDLE FOR HAND HELD UTENSILS AND IMPLEMENTS

This invention is in the field of utensils incorporating handles for hand held use. Particular examples of such utensils include knives, blades, razors, scrapers, and the like.

BACKGROUND OF THE INVENTION

When using a hand held utensil, the user frequently applies a typical action which consists of an approach movement, impact and a follow through. This action, which may be referred to as a swing action, is largely controlled by the thumb and occurs on a plain perpendicular to the long axis of the users forearm. The position of the thumb is important in co-ordinating an appropriate swing.

SUMMARY OF THE INVENTION

In the present invention it has been found that the position of a thumb, and on occasion other digits such as the user's index finger, may in fact be appropriately altered during the swing action. That is, when using certain utensils the position of the thumb may preferably be in a first position in the approach and/or impact stages of the action and in a second position during the impact and/or follow through. More typically, such utensils may be used in different ways such that they are presented to a second article, such as a person's face in respect of a razor, at different angles or orientations. To maximise the ease and comfort in which a utensil is applied to the article, the grip on the utensil may be altered depending upon the angle or orientation at which it is presented. It is recognised in the present invention that it is desirable to provide a handle on a utensil which facilitates or encourages a user to adopt an appropriate grip of the utensil which is dependant on the angle of presentation of the utensil and which does so in a manner that is apparently automatic or subconscious to the user.

Hand held utensils typically comprise a tool portion and a handle portion. Often the tool portion forms the head of the utensil. It is known that in respect of many utensils the angle at which the tool or head of the utensil is applied or presented is influential on the effectiveness of the function of the tool. For example, the angle of orientation of the bristles of a tooth brush relative to the teeth and gum is very important. When the bristles are addressed to the teeth orthogonally there is a much greater possibility that the bristles will bridge over the gaps between the teeth and those gaps or inter-proximal areas will not be properly cleaned. On the other hand, by tilting the bristles in the direction of the gum or roots of the teeth the bristles are far more likely to access these inter-proximal areas.

In another example attempts have been made to offer flexibility in the angle of presentation of the head of a razor. Some razors have been designed with pivotal heads, although generally the degree of pivot has been relatively small and unidirectional.

An object of the present invention is to provide a means integral with a utensil's handle which increases the comfort of use of that utensil, notwithstanding the angle at which the utensil is presented and notwithstanding the stage of the action or motion in which the utensil is used at any particular instant. The invention particularly attempts to negate awkward wrist or arm actions associated with the use of hand held utensils.

According to a first aspect of the present invention there is provided a hand held utensil having a tool or head portion and a handle, characterised in that the handle includes means for encouraging a user of the utensil to present the head or tool portion to an article at a preferable angle or tilt.

The handle includes means for encouraging a user of the utensil to change his or her hold on the handle when moving from presenting the utensil to an article at one angle or orientation to presenting the utensil to the article in an alternative angle or orientation.

Preferably the means includes the positioning or attachment of the handle at an off-set or tilted angle from the head or tool portion.

The means also preferably includes a grip on or integral with the handle which encourages the user to change his or her hold on the handle when appropriate for reasons of improving the effectiveness or comfort in use of the utensil as a consequence of the angle at which the utensil is presented to the article.

The grip may advantageously be a moulded thumb rest which spirals from a first position substantially central to the longitudinal axis of the handle to a second position substantially outside the longitudinal axis of the handle, the spiral being formed in the direction of off-set of the head or tool portion as it approaches the head of the utensil.

The head or tool portion and spiral thumb grip would tilt to the right when viewed in plan view for a right-handed user, and tilt to the left for use by a left-handed user.

BRIEF DESCRIPTION OF THE DRAWING FIGURES

An example embodiment will now be described with reference to the accompanying figures in which.

Figure 1:
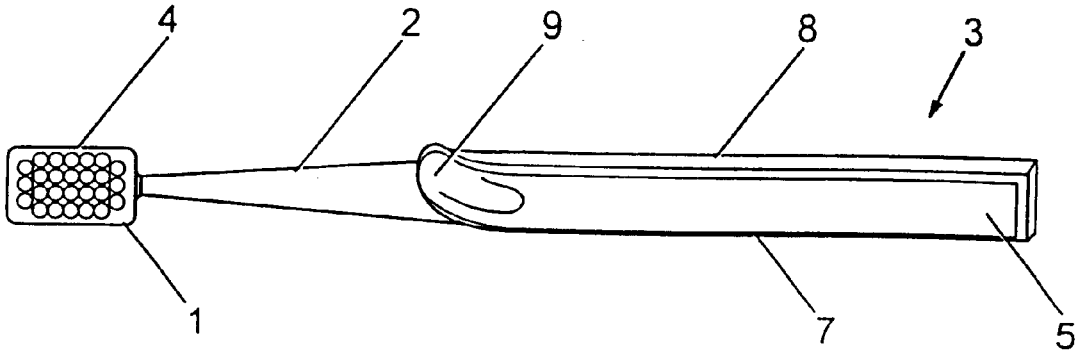
FIG. 1 shows a plan view of the toothbrush incorporating the invention.
Figure 2:
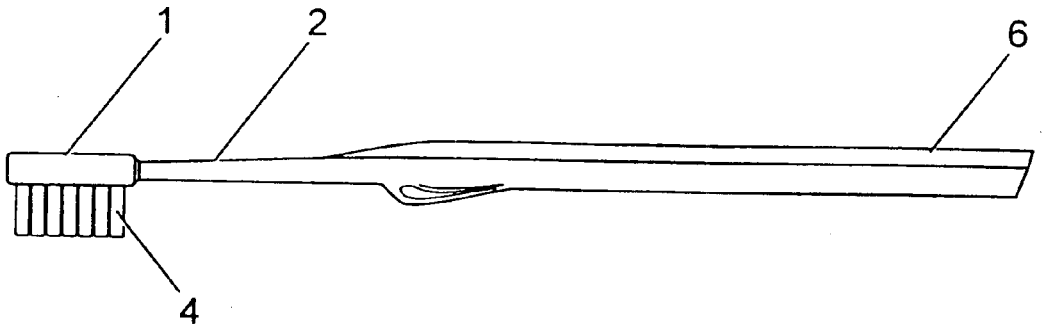
FIG. 2 shows a side elevation of the toothbrush embodiment shown in FIG. 1.
Figure 3:
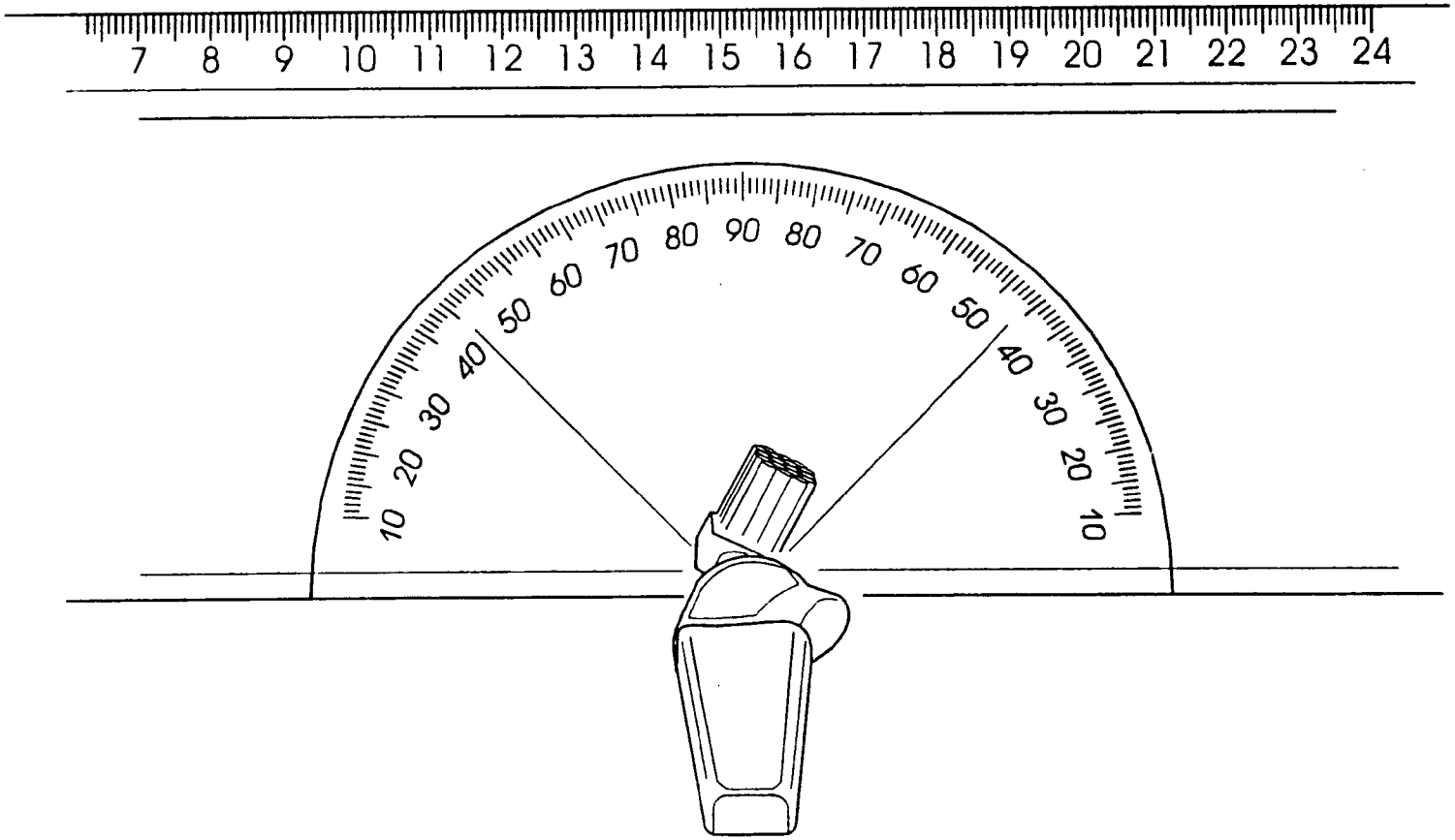
FIG. 3 shows an end view of the embodiment shown in FIGS. 1 and 2 above.

In FIGS. 1 to 3 there is shown a toothbrush comprising a head 1, neck 2 and handle 3. The head 1 incorporates a plurality of bristles 4.

DETAILED DESCRIPTION OF THE PREFERRED EMBODIMENTS

The shape of the handle 3 is important to the invention. In the embodiment shown the handle is of substantially rectangular cross section having two relatively long faces, these being an upper 5 and lower 6 face, and two relatively short faces or edges, these being left 7 and right 8 faces.

The handle 3 is attached to the head 1 via the neck 2 at an offset angle of approximately 15 degrees. That is, the bristles 4 which extend from the head 1 extend in a direction 15 degrees from the vertical when the lower face 6 of the handle is resting substantially flat on a horizontal surface.

The embodiment shown in FIGS. 1 to 3 is intended for use by a right handed person and thus it is appropriate for the bristles to be offset in a direction toward the right of the vertical, as shown. The relative tilt of the bristles to the handle means that when a user holds the handle conventionally the bristles are encouraged to address or be presented to at least the upper left molars and premolars and lower right molars and premolars at a preferable angle facilitating the edges of the bristles accessing or better accessing the interproximal spaces between the teeth in these areas.

The handle 3 further comprises a thumb grip 9 which is formed in the shape of a spiral groove, the groove 20 being substantially continuous with a concave longitudinal groove running along the upper face 5 of the handle 3. In use it is a simple and relatively automatic movement for the thumb to slide from the continuous longitudinal groove 20 on the upper face 5 of the handle 3 along towards the outer most point on the spiral portion of the groove 20. However, by doing this the angle or orientation of the brush as it is comfortably held is altered. Advantageously, with the thumb in this altered position towards the extremity of the spiral groove 20 the bristles may be presented at a preferable angle or tilt to the lower left molars and premolars and the upper right molars and premolars.

The feature of providing the extremity of the spiral groove 20 offset from the central longitudinal axis of the handle 3 is advantageous in that it provides further leverage to the user when brushing these latter mentioned areas of his or her teeth.

It may be seen from the embodiment described that the invention allows desirable bristles and bristle formation to be employed. It does not require the use of longer outside bristles which are prone to deformation.

Figure 4:
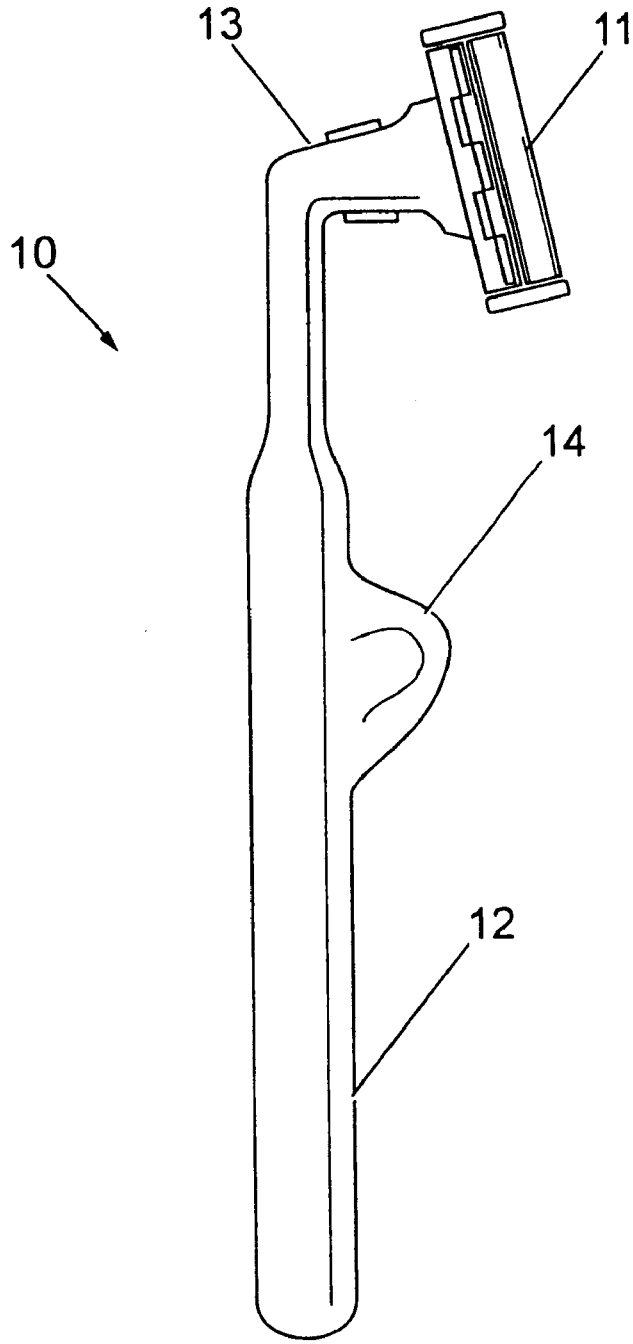
FIG. 4 illustrates a side elevation of a razor.

Turning to FIG. 4 there is demonstrated an alternative utensil to which the invention is applied. A razor, generally referenced 10, includes a head or tool portion 11 and a handle 12. The head 11 is connected to the handle 12 by a neck 13 which orients the head 11 at an angle off-set from the longitudinal axis of the handle 12.

The handle 12 also includes a rest 14 which, in the example embodiment shown in FIG. 4, is suitably moulded to receive a user's thumb and or index finger. As the rest 14 extends laterally from the axis of the handle 12 it may serve to provide leverage in use, enabling an enhanced control of the utensil, and particularly the head 11, in directions other than that which is axial to the longitudinal axis of the handle.

The particular digit of a user's hand used to operate the lever function of the handle may vary in accordance with the angle at which the razor 10 is presented to the user's face or body. It has also been found in the invention that the handle provides for, a comfortable grip by the user such that the function of the rest 14 and the handle 12 are interchanged, causing the end 12*a* of the handle 12 to afford a lever function.

Similar designs may be employed in relation to a large number of utensils including those which have been aforementioned herein, paintbrushes, screwdrivers and other mechanical tools and so on.

Other modifications and improvements may be incorporated without departing from the scope of the invention hereintended.

What is claimed is:

1. A hand held utensil comprising;

a head having a face and a tool mounted on said face, a handle having a longitudinal axis and an oblong cross section that is substantially constant along most of said handle, said oblong cross section having a short left surface, a short right surface, a long upper surface and a long lower surface, said long upper surface being rotationally offset from said face, a finger rest extending protuberantly from said handle, said finger rest having a first end further from said head and a second end closer to said head, wherein said finger rest spirals continuously about the longitudinal axis from said first end to said second end, said spiraled finger rest being generally coplanar with said long upper surface at said first end of said finger rest, said spiraled finger rest being generally parallel with said face and protuberantly offset from said handle at the second end of said finger rest, whereby the finger rest provides a continuous surface over which the movement of a user's digit provides leverage or torque to the handle that twists the handle relative to the users hand.

2. A hand held utensil according to claim 1 wherein the finger rest includes a molded ridge.

3. A hand held utensil according to claim 1 wherein the finger rest includes a molded groove.

4. A hand held utensil according to claim 1 suitable for use by a right handed person wherein the face of the head is rotated clockwise of the longitudinal axis when the utensil viewed from the handle end.

5. A hand held utensil according to claim 1 wherein said utensil is a toothbrush.

* * * * *